United States Patent [19]

Spier et al.

[11] 3,945,599

[45] Mar. 23, 1976

[54] PICTURE HOOK

[75] Inventors: I. Martin Spier; Richard H. Arbib, both of New York, N.Y.

[73] Assignee: Level-Line Products, New York, N.Y.

[22] Filed: June 8, 1973

[21] Appl. No.: 368,396

[52] U.S. Cl. ..... 248/476; 248/298

[51] Int. Cl.[2] ..... A47G 1/24

[58] Field of Search ..... 248/298, 476, 477, 489, 248/495, 496, 497, 498

[56] References Cited

UNITED STATES PATENTS

| | | | |
|---|---|---|---|
| 2,291,966 | 8/1942 | Joseph | 248/298 X |
| 2,740,603 | 4/1956 | Wofford | 248/496 X |
| 3,063,666 | 11/1962 | Morrison | 248/467 X |
| 3,360,229 | 12/1967 | Beyer | 248/496 |

*Primary Examiner*—William H. Schultz

*Attorney, Agent, or Firm*—Blum, Moscovitz, Friedman & Kaplan

[57] ABSTRACT

A picture hanging arrangement in which an elongated horizontal member is fastened to the wall surface from which a picture is to be suspended. A vertical elongated member is slidingly arranged along the horizontal member fastened to the wall. The verical member is provided with a plurality of notches into which the picture hanging wire may be inserted. Selection of the notches into which the picture hanging wire is inserted, allows varying the position of the picture along the vertical direction on the wall, whereas sliding of the vertical member along the horizontal member allows varying of the picture position along the horizontal direction on the wall.

9 Claims, 3 Drawing Figures

PICTURE HOOK

BACKGROUND OF THE INVENTION

This invention relates generally to a picture hook and especially to a picture hook which permits varying or adjusting the position of the picture on a wall after hanging of the picture. While picture hooks have taken various forms, such conventional picture hanging hooks have not made it possible to easily vary or adjust the position of a picture, after the hook was fastened to the wall, without tilting the picture. Picture hook arrangements providing for any adjustability, furthermore, have been complex in design, costly to fabricate, and difficult to install by the user.

SUMMARY OF THE INVENTION

Generally speaking, in accordance with the invention, a picture hanging arrangement is provided in which a plastic elongated member is fastened to the wall with its axis oriented horizontally. This horizontal elongated member has two holes at the ends of the member, through which nails may be inserted for fastening the member to the wall. The horizontal member has, on its rear side, grooves along which a vertically-oriented elongated member slides. The vertical member has a plurality of notches along a predetermined length of the vertical member, into which the picture hanging wire may be inserted. By varying the selection of the notch into which the picture hanging wire is inserted, the height of the picture in the vertical direction can be adjusted or varied. By slidingly varying the position of the vertical member along the horizontal member, furthermore, the position of the picture may be varied in the horizontal direction, without tilting the picture. With the notch arrangement on the vertical member in combination with the sliding feature by which the vertical member is slidable along the horizontal member, the picture may be adjusted in position both horizontally and vertically without tilting or causing an off center effect.

Accordingly, it is an object of this invention to provide an improved picture hook arrangement which allows varying the position of a picture in both horizontal and vertical directions without tilting of the picture after the hook has been fastened to a wall.

Another object of the invention is to provide an improved picture hook which allows varying the position of a picture along a wall without adjustment in the picture hanging wire.

A further object of the invention is to provide an improved picture hook arrangement which may be fastened to a wall surface while minimizing cracking of the wall plaster.

Still another object of the invention is to provide an improved picture hook which is simple in design, and may be economically fabricated and installed without requiring special skills or tools.

Still other objects and advantages will in part be obvious and will in part be apparent from the specifications and drawings.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
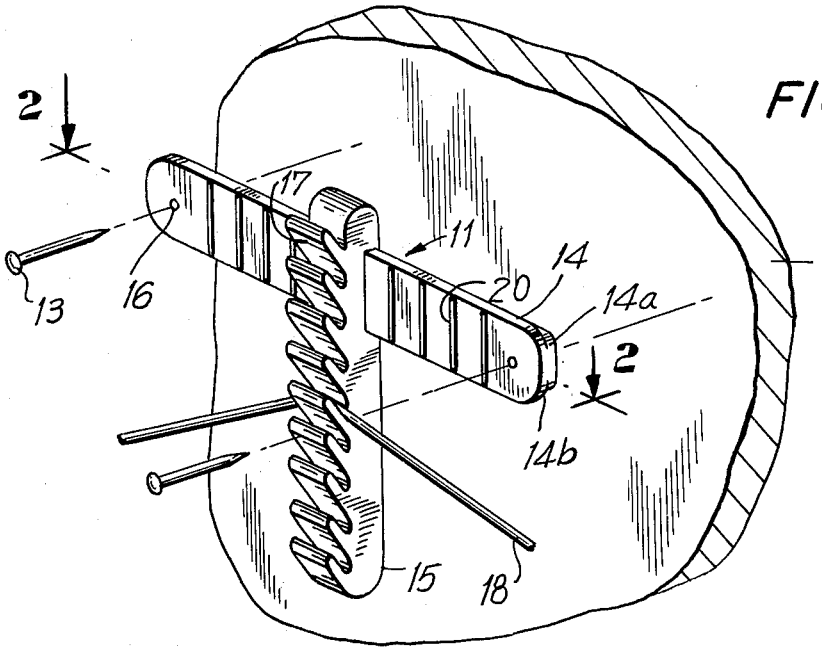
FIG. 1 is a perspective view of a picture hook arrangement in position for fastening to a wall, in accordance with a preferred embodiment of the instant invention.
Figure 2:
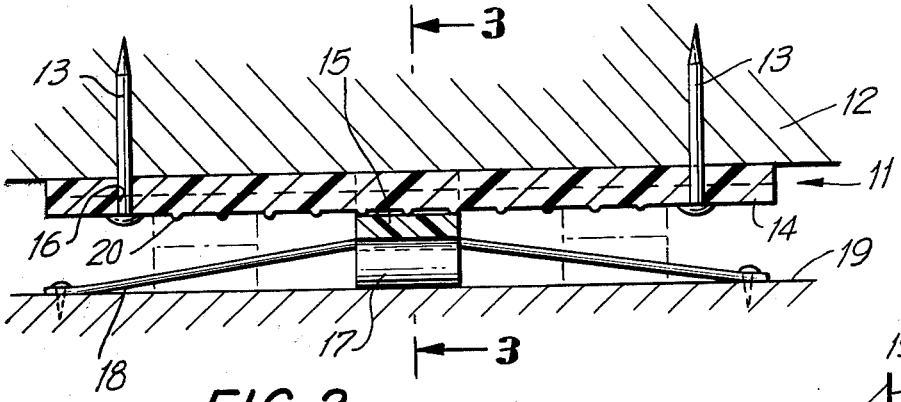
FIG. 2 is a sectional view taken along line 2—2 in FIG. 1.

Referring now to FIGS. 1 and 2, a picture hook arrangement indicated generally at 11 is fastened to the wall 12 with fastening devices which may be in the form of nails 13, for example. The picture hook arrangement has a horizontally-oriented elongated member 14 which may be made of plastic for economical fabrication. The elongated member 14 is provided with an upper groove 14a and a lower groove 14*b* which serve as sliding grooves for a vertical elongated member 15. The grooves 14*a* and 14*b* are ledge-shaped or L-shaped for firmly holding the member 15 without the danger that this member 15 may become separated from the member 14 and thereby drop the picture from the wall.

Figure 3:
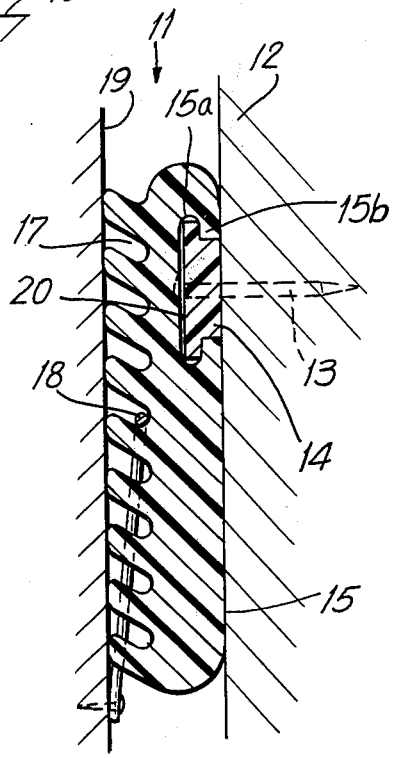
FIG. 3 is a sectional view taken along line 3—3 in FIG. 2.

To mate with the grooves 14*a* and 14*b* of the horizontal member 14, the vertical member 15 is provided with an internal recessed groove 15*a* in which the member 14 slides. As may be seen from FIG. 3, the groove 15A is shaped to closely conform to the profile of the grooves 14*a* and 14*b*. Part of the recessed groove of the member 15, is the extending portion 15*b* which bears against the back side of the member 14 to prevent the member 15 from slipping off the member 14. Thus, the groove 15*a* is shaped to substantially wrap about the member 14 and thereby provide a slidable assembly of the horizontal and vertical elements, while guarding against accidental separation of these elements while in service and to also prevent relative rotation in a plane parallel to the plane of the wall to which the assembly is mounted.

For fastening against the wall 12 the horizontal member 14 has two holes or openings 16 through which nails 13 may be freely passed. The nails 13 are hammered, furthermore, into the wall 12 in a manner so that the longitudinal axis of the nail 13 is perpendicular to the surface of the wall 12. This right-angle arrangement of the nail 13 and wall 12 prevents or minimizes cracking of the plaster or plaster board of which the wall is fabricated, when hammering the nail. Conventional picture hooks require hammering the nail at an angle inclined to the wall, for fastening a conventional hook to the wall. When hammering the nail at such an inclined angle to the wall, cracking of the surface plaster on the wall is often encountered. The perpendicular arrangement of the nail and the wall surface, in accordance with the present invention, substantially reduces such cracking of the wall plaster while hanging a picture.

The vertically-oriented member 15 is provided with a plurality of notches 17 along the length of the member. Picture hanging wire 18 attached to the back of a picture frame 19 may be inserted into any selected one of the notches 17. The notches 17, furthermore, form an acute angle with the upper vertical to form a safety structure which prevents the picture wire 18 from slipping accidentally out of the notches 17. Thus, the notches 17 are inclined upwards, and this arrangement assures that the picture hanging wire 18 always rests at the interior end of the notch which is well below the exposed end of the notch as a result of the inclination. The weight of the picture and frame 19 prevents the wire 18 from riding up the notch and sliding or slipping out of the notch thereafter.

The distribution of a plurality of notches 17 along the length of the vertically-oriented member 15, make it possible to vary the height or vertical position of the picture to conform to the desires and wishes of the user or consumer. Thus, the picture may be centered on the hook arrangement, without tilting of the picture, at various positions along the vertical, by moving the wire 18 among the notches 17 provided on the member 15. At the same time, the picture may be moved in horizontal position, as desired by the user or consumer, by sliding the member 15 along the horizontally-oriented member 14. It may be seen from the arrangement in accordance with the present invention, that movement of the vertical member 15 relative to the horizontal member 14 will not cause tilting of the picture. As a result, a consumer or user may vary the position of the picture in both vertical and horizontal directions without tilting the picture during such adjusting movement or operations and without the need for changing the position of the picture hook. In other words, minor adjustment in position of the picture along the vertical and horizontal axes is easily accomplished.

To retain the vertically-oriented member 15 in predetermined position after adjustment has been made by a user or consumer, the horizontally-oriented member 14 is provided with rib-shaped raised projections 20. These raised projections 20 are oriented at right angles to the longitudinal axis of the member 14, and move into the groove 15*a* as the member 15 is slid along the member 14. When these raised projections 20 are within the groove 15*a* they bear against the internal recessed surface of the groove 15*a*, and thereby against the member 15. This bearing pressure of the projections 20 against the member 15, prevents this member from creeping along the member 14 as a result of vibrations that may be experienced, for example, by the wall. These raised projections 20, furthermore, may also be used as indexing elements which aid the user or consumer to remember predetermined positions of the picture that were considered in finding an optimum position, for example, for the picture during the adjustment operation.

In the use of the picture hook arrangement, in accordance with the present invention, the member 15 is first slid onto the member 14. The member 14 is then fastened to the wall 12 by means of the nails 13. After the member 14 has thus been fastened in place, the member 15 is prevented from sliding off the ends of the member 14 by the heads of nails 13. As a result, the member 15 is at all times securely assembled in a safe manner to the member 14. The picture hanging wire 18 is then inserted into a selected one of the notches, and a desired position for the picture may be obtained without tilting the picture by moving the member 15 along the member 14 and varying the selection of the notches for insertion of the wire 18, as required.

The picture hook elements 14 and 15 are preferably formed from plastic material. At the same time, they may also be made of metal or wood, for example, depending on which material may be most economical at a predetermined time of fabrication. The length of the horizontally-oriented member 14 determines substantially the horizontal distance to which the picture may be adjustably moved without tilting. The length of the member 15 together with the number of notches provided thereon, on the other hand, determines the distance in height through which the picture may be adjustably positioned.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A picture hook arrangement comprising, in combination, a first elongated member for fastening to a wall and a second elongated member, one of said first and second elongated members having at least one groove portion extending along the longitudinal axis thereof for slidably retaining said other elongated member in a direction parallel to the longitudinal axis of said first elongated member, said second elongated member having means integrally formed therewith for suspending a picture wire and the like from different locations along the length of said second elongated member, said suspension means being poisitioned along a line substantially perpendicular to said longitudinal axis, a picture being adjustable in directions along the longitudinal axes of said elongated members without tilting by slidably moving said second elongated member relative to said first elongated member and moving the location on said second elongated member from which said picture wire and the like is suspended.

2. The arrangement as defined in claim 1 wherein said groove portion is on said first elongated member and is substantially L-shaped.

3. The arrangement as defined in claim 2 wherein said groove portion is on said first elongated member, and said second elongated member has a recessed groove portion mating with the groove portion of said first elongated member, the groove portion on said second member having projections mating with the groove portion of said first member so that said second member is inseparable from said first member when said first member is fastened to a wall.

4. The arrangement as defined in claim 3 including raised rib-shaped elements on said first elongated member bearing against the interior recessed groove of said second member in predetermined position relative to said first member.

5. The arrangement as defined in claim 4 wherein said elongated members are of plastic material.

6. The arrangement as defined in claim 1 wherein said axes of said elongated members are at right angles to each other, said first elongated member being horizontally oriented on said wall and said second elongated member being vertically oriented with respect to said first elongated member.

7. The arrangement as defined in claim 1 wherein said horizontally-oriented first elongated member has a plurality of holes for fastening said horizontally-oriented member to said wall with fastening means directed perpendicular to the surface of said wall.

8. The arrangement as defined in claim 1 wherein said integrally formed suspension means on said second elongated member for suspending said picture from different locations along the length of said member comprises a plurality of notches distributed along the length of said second elongated member.

9. The arrangement as defined in claim 8 wherein said notches are directed upwards at an acute angle with the upper vertical directed along a wall.

* * * * *